United States Patent [19]

Brandigi et al.

[11] 3,939,759

[45] Feb. 24, 1976

[54] DEVICE FOR FORMING A SHAPED COVER FOR A FLASK

[76] Inventors: Carlo Brandigi, Tosi, Reggello; Giuliano Fantechi, S. Ellero, Reggello, both of Italy, I-50060

[22] Filed: Oct. 8, 1974

[21] Appl. No.: 513,074

Related U.S. Application Data

[62] Division of Ser. No. 308,722, Nov. 22, 1972, Pat. No. 3,869,966.

[52] U.S. Cl. ..... 93/54.3; 93/54 R; 215/12 R; 29/451

[51] Int. Cl.[2] ..... B31B 1/28

[58] Field of Search ..... 93/54 R, 54.2, 54.3, 1 R, 93/39.1 R, 40, 43, 55.1 R, 55.1 M; 215/12 R; 29/235, 451; 229/89, 90, 91

[56] References Cited

UNITED STATES PATENTS

| | | | |
|---|---|---|---|
| 1,018,319 | 2/1912 | Heyl | 93/55.1 R |
| 2,293,142 | 8/1942 | Johnson | 93/54 R X |
| 2,814,240 | 11/1957 | Kuchler et al. | 93/55.1 M |
| 3,406,441 | 10/1968 | Larsson | 29/451 |
| 3,505,725 | 4/1970 | Curry | 29/451 |

FOREIGN PATENTS OR APPLICATIONS

| | | | |
|---|---|---|---|
| 1,096,785 | 1/1961 | Germany | 229/91 |

*Primary Examiner*—James F. Coan
*Attorney, Agent, or Firm*—McGlew and Tuttle

[57] ABSTRACT

A cover for a flask, for example a flask of Italian wine, is formed from a skirt comprising lengths of strip-like material. The skirt is arranged around the flask or around a body resembling the flask, and the lower end portions of the strips are deformed around an annular core which forms a base for the cover, the lower end portions being clamped between the inner surface of the core and a plug inserted into the core.

3 Claims, 13 Drawing Figures

Fig.8
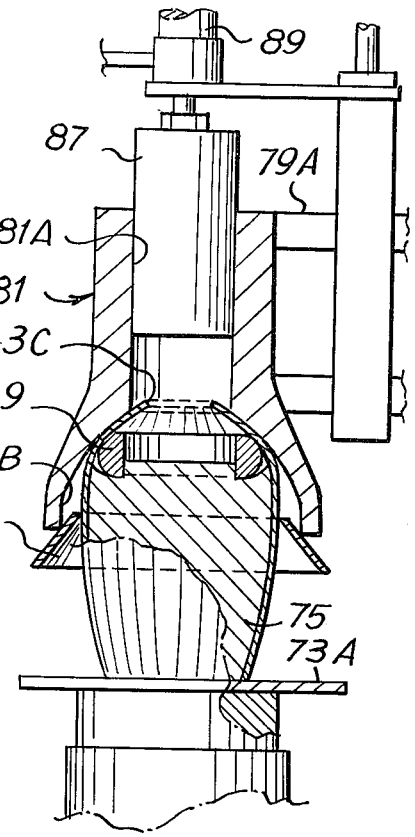
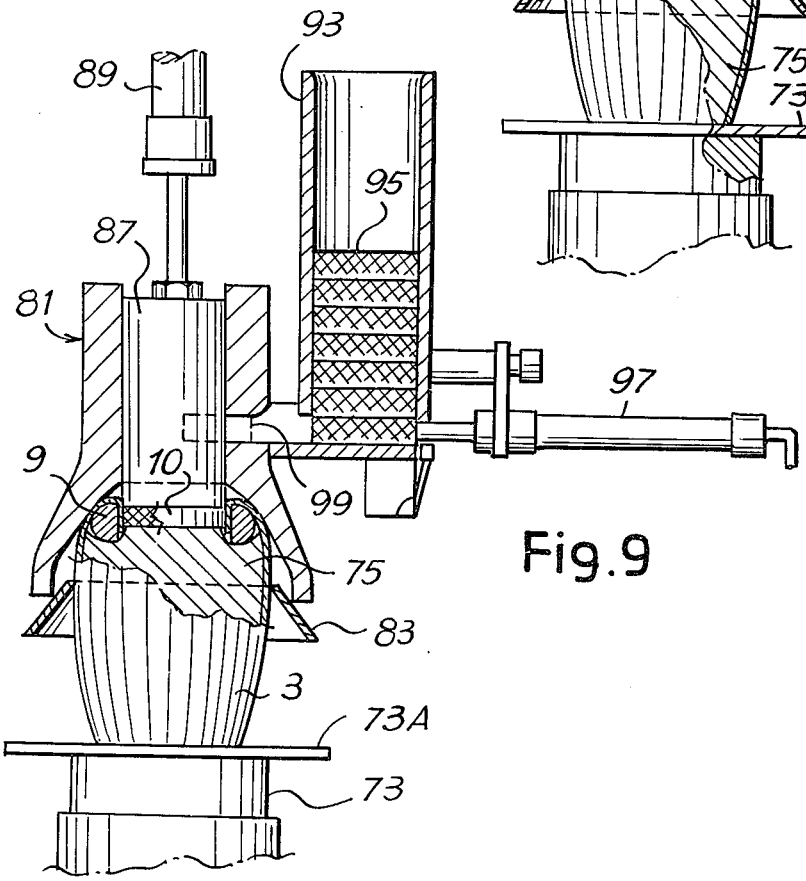
Fig.9

DEVICE FOR FORMING A SHAPED COVER FOR A FLASK

This is a division of application Ser. No. 308,722 filed Nov. 22, 1972; now U.S. Pat. No. 3,869,966.

The present invention relates to a device for forming a shaped cover for a flask of the type typically used to package Italian wine and especially Tuscany wine known as Chianti, such a flask being known as a "fiasco."

SUMMARY OF THE INVENTION

According to the present invention, there is provided a device for forming a shaped cover for a flask from a skirt comprising lengths of strip-like material, the device comprising a supporting body, means for centering, relative to the body, an annular core for forming a base of the cover, an axially movable assembly operative to displace one end portion of each length of strip-like material of a skirt arranged around the body whereby the end portions lie above the recess in the annular core, and means for inserting plug means into the recess whereby the end portions are engaged between the inner surface of the core and the plug means and are retained thereby.

Embodiments of the invention will now be described, by way of example only, with reference to the accompanying diagrammatic drawings, in which:

FIG. 8 is a longitudinal section of the device illustrated in FIG. 6, but showing the device during a different stage of its operation;

FIG. 9 is a section taken on line IX—IX of FIG. 7; and

DESCRIPTION OF THE PREFERRED EMBODIMENTS

Figure 1:
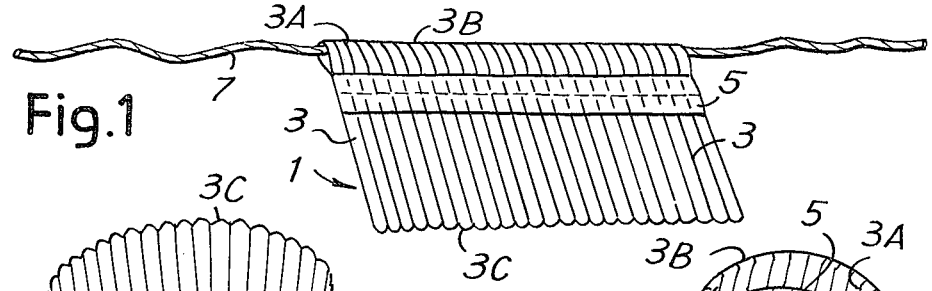
FIG. 1 is a perspective developed view of a skirt for forming a cover of a flask.

Referring initially to FIGS. 1 to 4, a cover for a flask 12 is in the form of a skirt 1, comprising a plurality of lengths 3 of a strip material. This material may be a natural material of marsh grasses (Typha latifolia Linn) or, preferably, an artificial material resembling marsh grasses, for instance, strips of paper glued in several layers, colored in a generally irregular manner and embossed in order to provide the appearance of marsh grass both as to cross-sectional shape and to surface finish. Alternatively, the material can be formed by lengths of marsh grasses applied onto an endless paper tape and narrower than the grass width. The lengths 3 of the strip-like material are arranged side-by-side and are partly overlapped to form the skirt 1 in which the individual lengths of material can be slightly spread apart in order to follow the profile of the ovoidal body of the flask 12. One end portion 3A of each of the lengths 3 is folded over onto the inner surface of the skirt and is secured in a suitable manner, for example using an adhesive or - as shown in the drawing - by means of an adhesive tape 5. Thus the folded-over end portions 3A form a sheath extending transverse to the lengths 3, a string or cord 7 being incorporated within the sheath during the formation thereof. The upper edge 3B of the finished skirt lies adjacent a bare shoulder of the flask 12. In an alternative arrangement, the skirt 1 can be formed on the flask body using an annular element which replaces the cord 7.

The other end portions 3C of the lengths 3 of strip material are shaped to form a base to enable the flask 12 to to be supported on a horizontal surface. The base comprises an annular core 9, which can be made of expanded polystyrene or other expanded synthetic resin, or other suitable material, and which is shaped outwardly with the profile that the base is to assume, and is shaped internally with a cylindrical profile. The end portions 3C of the lengths 3 are folded inwardly around the core 9 to contact with its cylindrical surface, the end portions 3C being held in this position by means of a disc-like annular pad 10, or other tubular plug, formed of a relavitely resilient expanded resin forced into the interior of the core 9 so as to clamp the end portions 3C against the inner surface of the core 9.

The skirt 1, formed by the lengths 3, surrounds the flask body and covers completely the annular core 9.

Figure 2:
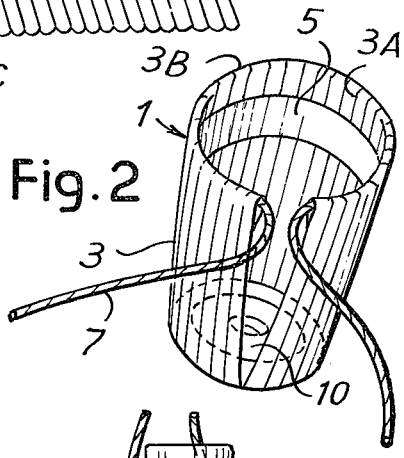
FIG. 2 is a perspective view of a cover formed by a device in accordance with the invention.

In order to apply the skirt to the flask 12, an assembly is produced as shown in FIG. 2 and comprises the skirt 1 clamped to the core 9 using the pad 10, the side seam of the skirt remaining open. The assembly is then arranged on the body of the flask 12, in such a manner that the flask bottom lies on the annular core 9 and is centered thereon in a suitable manner. Then the upper edge 3B is drawn against the shoulder of the flask 12 using the cord 7. The cover formed by the skirt 1 extends completely around the body of the flask 12 with the lengths 3 uniformly arranged. The cord 7 is bound or fixed, for example using a metal fastener or adhesive, and also forms the windings 7A and the handling loops 7B (FIG. 4) characteristic of this type of flask. Each end portion of the cord or at least the end portion thereof forming the handling loop 7B is bound and appropriately anchored to the edge 3B by being engaged with the portion of the cord within the sheath. After the edge 3B has been drawn against the flask, there is also formed a binding 14 (FIG. 4) between the body of the flask 12 and the base formed by the annular core 9. This binding 14 effects tensioning of the lengths 3 and causes them to follow the curvature of the flask body.

Such a cover formed from an artificial strip-like material, for instance, paper, is very similar in appearance to that of a traditional cover formed manually by skilled personnel.

Figure 5:
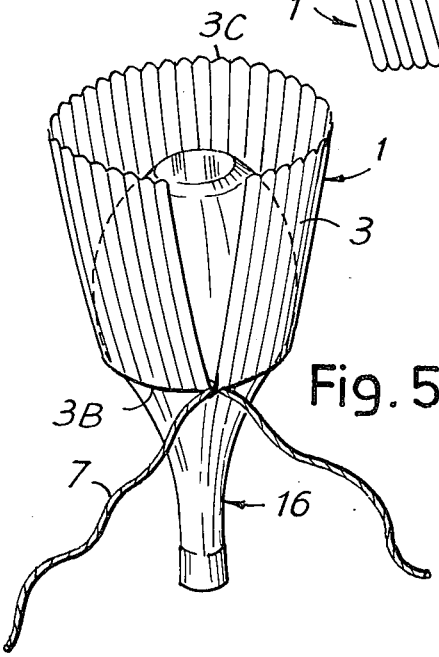
FIG. 5 is a perspective view of a skirt applied directly to a flask.

A modified method of applying the skirt 1 to the flask body is shown in FIG. 5 and obviates the need to form the assembly as shown in FIG. 2. According to the procedure shown in FIGS. 1 to 4, the assembly of FIG. 2 is formed on a core having a shape corresponding to that of the flask body. The core is also shaped to accommodate and center the annular core 9 which provides the base, the assembly of FIG. 2 being removed from the core prior to its application to the flask in the described manner. According to FIG. 5, the edge 3B is drawn directly onto a flask 16 by using the cord 7. The annular core 9 is positioned on the flask bottom and forms, with the other end portion of the lengths 3 and with a pad 10 or the like, a base directly applied to the flask, the base being formed in the same manner as described above. The cover is completed by forming the windings 7A, the loops 7B and the binding 14. According to an additional variation, the skirt 1 is formed directly on the flask body in the manner of FIG. 5, the cord 7 being replaced by a thin ring.

Figure 3:
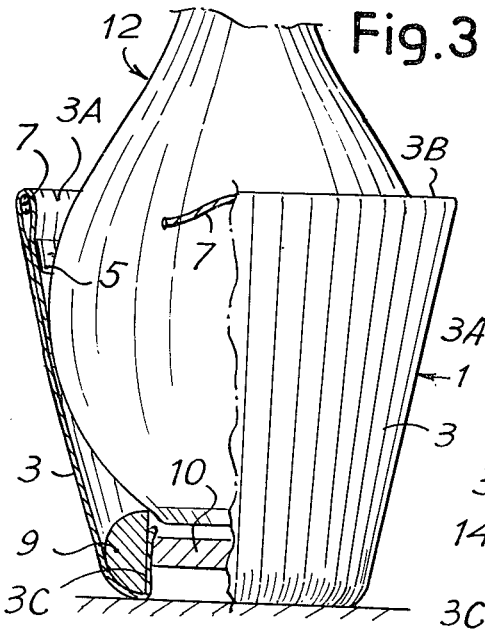
FIG. 3 is a side elevation partly in section, and showing the cover located on the flask.
Figure 4:
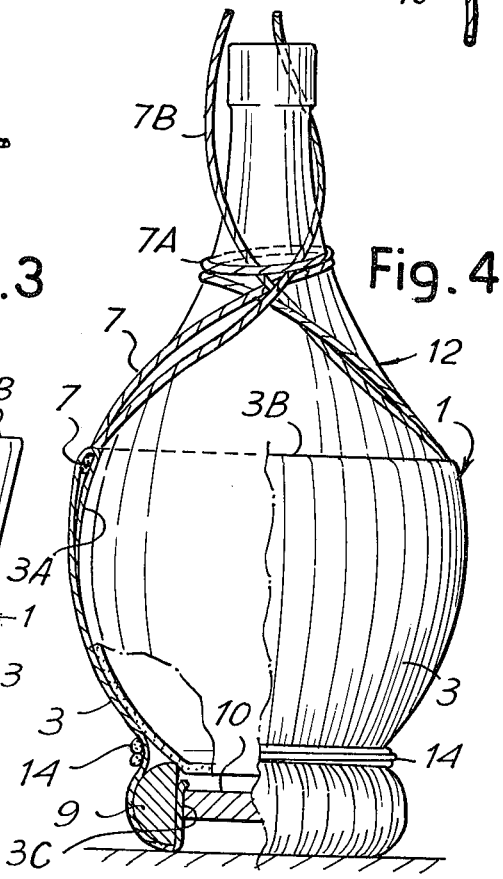
FIG. 4 is an elevation, similar to FIG. 3 and showing a completed cover on the flask.

The forming of the skirt 1 with the cord 7, and its application using the procedure shown in FIGS. 2 and 3, or FIG. 5 can be carried out substantially automatically or by using only a restricted amount of labor.

A device for forming the cover is shown in FIGS. 6 to 9, and comprises a base 71 mounting a support 73 carrying a horizontal plate 73A. A core 75 extends upwardly from the plate 73A and can have a cylindrical shape or a shape similar to that of the portion of the flask body which is to be covered. On its upper surface the core 75 has a circumferential stepped profile provided by a groove and which serves to center thereon an annular core 9 for forming the base. When the annular core 9 is centered on the core 75 at least a portion of the inner cavity of the annular core 9 is free.

On the base 71 a frame 77 is provided to guide a unit 79 for vertical movement. Unit 79 supports, by means of arms 79A, a tubular die member 81 having a cylindrical portion 81A and an entry position 81B. Entry portion 81B is in the form of a downwardly-directed annular member 83 of frusto-conical form supported from the member 81 by resilient means 85 which bias the member 83 axially with respect to the member 81. A piston 87 is slidable in the cylindrical portion 81A of the member 81, piston 87 being operated by a hydraulic or pneumatic cylinder 89 carried by the unit 79. Vertical movement of the unit 79 is effected by a cylinder 91.

On one side of the member 81 there is located a magazine 93 (FIGS. 7 and 9) for a plurality of pads 95 which constitute the pads 10, used to clamp the end portions 3C of the lengths 3 of the skirt. The lowermost pad in the magazine 93 can be withdrawn laterally from the magazine 93 by the piston of a cylinder 97 and fed into the cylindrical portion 81A through an inlet 99.

Figure 6:
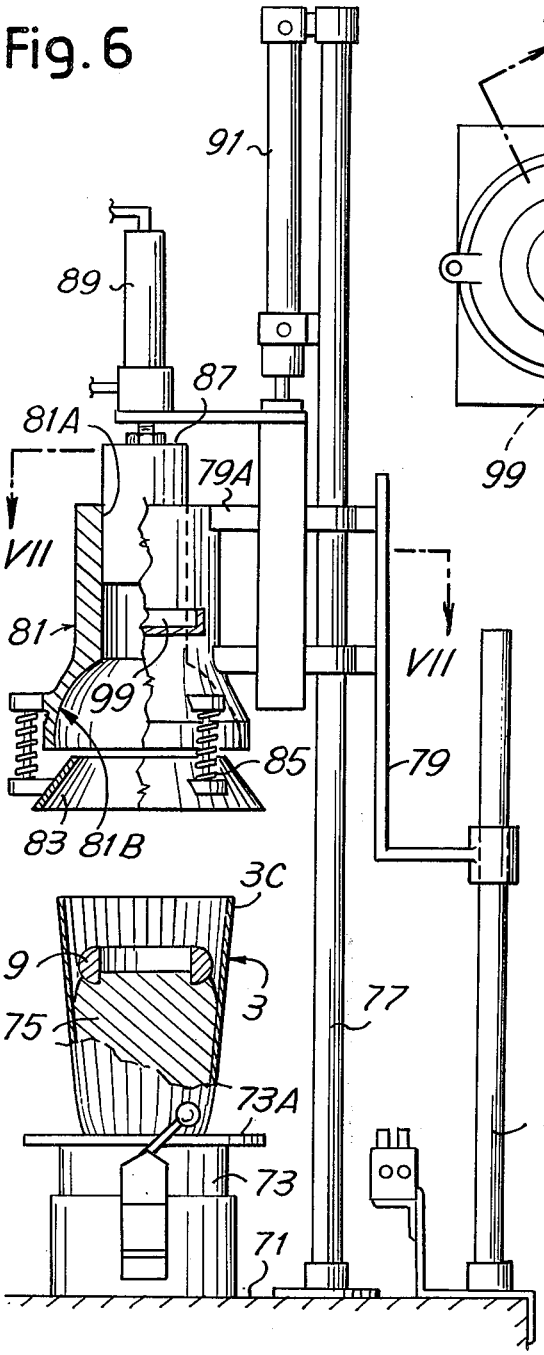
FIG. 6 is a side elevation of a device for forming the cover of FIG. 2.
Figure 7:
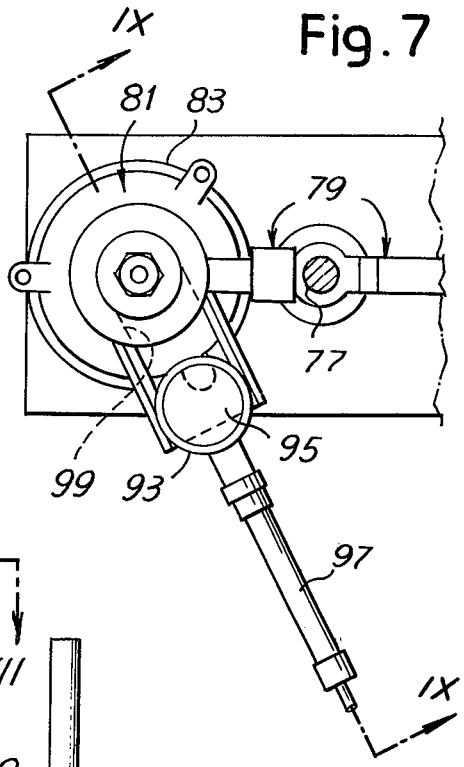
FIG. 7 is a section taken on line VII—VII of FIG. 6.
Figure 10:
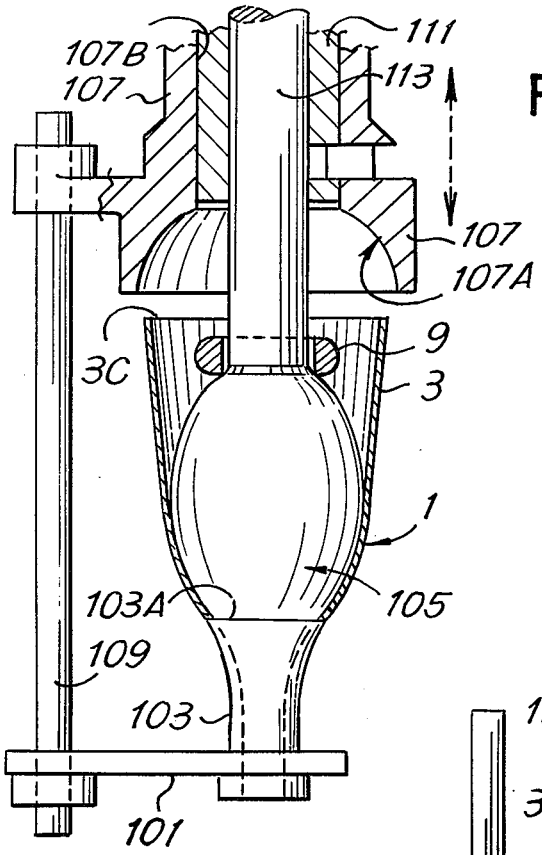
FIGS. 10 to 13 are vertical sections of a modified form of the device illustrated in FIG. 6, and showing the device in various stages of its operation.

The plate 73A and the core 75 form, at their junction, an annular shoulder or rim arranged to locate the upper edge 3B of the skirt 1, and to permit the skirt 1 to be temporarily clamped to the core 75 using the cord 7. When the edge 3B of the skirt 1 is located as stated above, the lengths 3 of the skirt 1 are arranged as shown in FIG. 6, are upwardly directed and are slightly divergent from one another. The end portions 3C lie within an imaginary cylindrical surface having a smaller diameter than the maximum diameter of the annular member 83. The unit 79 together with the members 81, 83 is located in a raised position as shown in FIG. 6. The edge 3B of the skirt 1 may be drawn into a form similar to that which it will assume on the flask body, and can also be arranged in a position a little different to that to be assumed on the flask.

When the unit 79 is lowered, the annular member 83 surrounds the ends 3C and displaces them inwardly. Upon reaching the core 75, the smaller diameter upper edge of the annular member 83 presses the lengths 3 of the skirt 1 against the core, avoiding bending and divergence of the lengths due to combined bending and compressive stress. Additional lowering of the unit 79 is allowed by yielding of the resilient means 85. End portions 3C of the lengths 3 are moved by the portion 81B closer together and towards the axis of the core 75, until the end portions 3C extend laterally above the recess of the annular core 9 as shown in FIG. 8. A pad 95 from the magazine 93 is then fed through the inlet 99 into the cavity 81A, and the piston 87 is lowered from the position shown in FIGS. 6 and 8 to the position shown in FIG. 9, whereby the pad is forced into the interior of the annular core 9 and carries with it the end portions 3C so that these end portions are clamped in the manner described above.

After the member 81 and piston 87 have been raised and the core 7 released, the thus formed cover, which has assumed the contours of the assembly shown in FIGS. 2 and 3, can be removed.

The various operations described can be automatically effected in the appropriate sequence made in an automatic manner.

A device for forming the cover as described with reference to FIG. 5, is shown in FIGS. 10 to 13. The device comprises a support 101 for a hollow member 103, shaped like a funnel, and arranged to receive the neck and the shoulder of an inverted flask 105. The upper edge 103A of the member 103 and the flask 105 together define an annular shoulder or rim on which the skirt 1 is located, the skirt 1 being retained on the flask by means of the cord 7. Edge 103A together with the flask shoulder defines the exact position of the edge 3B of the skirt. The cord 7 is held by bindings, fasteners, or other suitable means.

Figure 11:
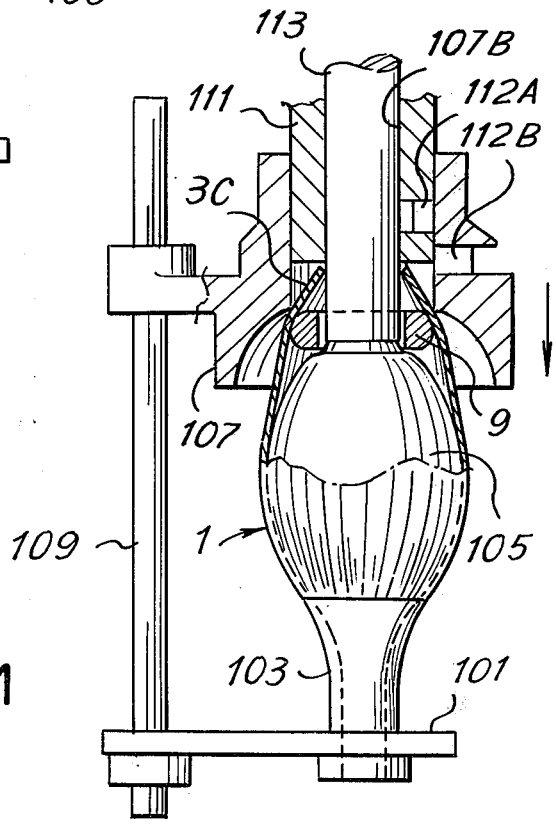
Figure 12:
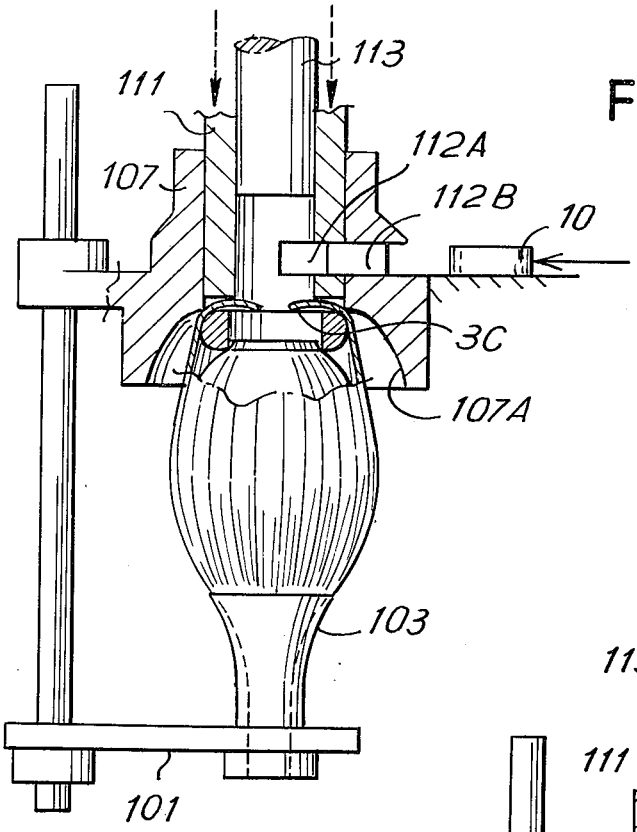
Figure 13:
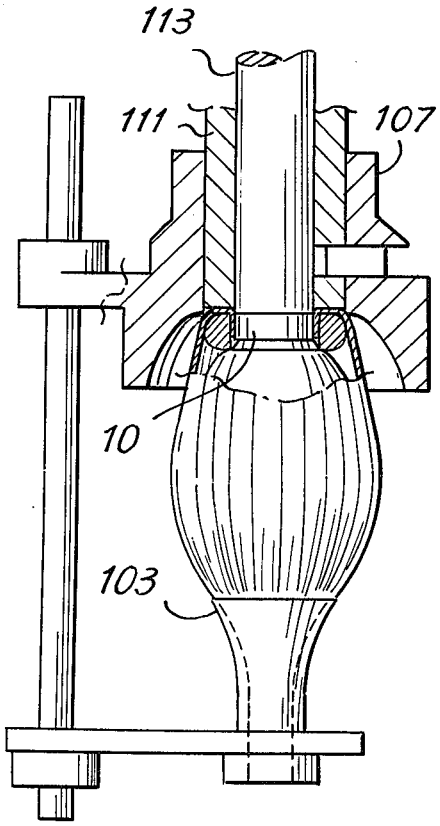

The lengths 3 of the skirt are directed upwardly towards an inlet portion 107A of a member 107, similar to the member 81 and having a cylindrical cavity 107B; the member 107 is axially slidable along a guide 109. In the interior of the cavity 107B there is provided a tubular element 111 arranged to receive a pad 10 the pad being fed through apertures 112A, 112B into the element 111 and member 107 when the apertures are aligned as shown in FIG. 12. A piston 113 is mounted in the element 111. For clarity, control means for the element 111 and piston 113, have not been shown, these control means being, for example, hydraulic or pneumatic cylinders. When the member 107 is in a raised position an annular core 9 can be arranged on the flask bottom, to be retained and centered in this position by lowering the piston 113 until it penetrates into the recess of the annular core 9. Under these conditions, by lowering the member 107, the end portions 3C of the lengths 3 are engaged by the portion 107B and are displaced towards the axis of the flask as shown in FIG. 11. When the member 107 has reached the level of the annular core 9 and has ensured the centering thereof, the piston 113 is raised and the tubular element 111 is lowered to allow the insertion of a pad 10 into the cavity of the element 111 through the apertures 112A and 112B, and to complete the displacement of the end portions 3C towards the flask axis. The piston 113 is then re-lowered to force the pad 10 into the annular core 9, in such a manner as to trap the end portion 3C of the lengths 3 in the manner above described.

In this manner the base of the cover is formed directly on the flask. The procedure is, generally, simplified with respect to the preceding example, but since the cover is formed on the flask either the flask and core must be transported to the place at which the flask is to be filled or the cover must be formed directly in the cellars in which the flask is to be filled.

What is claimed is:

1. A device for forming a shaped cover, for a flask having a bottom, a side wall and a neck, from a skirt constituted by lengths of strip-like material having free end portions, said device comprising, in combination, a supporting body adapted to receive an inverted flask having a skirt engaged therearound with the lengths of strip-like material extending along the exterior surface of its side wall with their free end portions extending upwardly beyond the flask bottom; means operable to center, relative to the flask bottom, an annular core, for forming a base of the cover, with such free end portions of the lengths of strip-like material extending upwardly beyond the annular core; an axially movable assembly including an inlet cup portion operative to engage such free end portions of the lengths of strip-like material to displace the same radially inwardly over the annular core to project radially inwardly from the inner periphery thereof; said assembly including means defining a cylindrical recess communicating with said inlet cup portion and coaxial with the annular core; means operable to feed laterally into said recess plug means engageable in the annular core; and piston means in said assembly displaceable axially to engage and displace the plug means axially inwardly from said cylindrical recess into engagement with the radially inwardly extending free end portions of the lengths of strip-like material to displace such free end portions axially inwardly over the inner periphery of the annular core and to force the plug means into the annular core to clamp the free end portions of the lengths of strip-like material between the plug means and the inner periphery of the annular core.

2. A device according to claim 1, wherein said assembly further comprises an annular member located ahead of said inlet cup portion and operative to retain the lengths of strip-like material around the body and with the free end portions thereof resting against the external periphery of the annular core and extending inwardly across the annular core and radially inwardly of the inner periphery thereof; and resilient means mounting said annular member for axial movement relative to said inlet cup portion.

3. A device according to claim 1 wherein the piston means constitutes said centering means and is operative to center a said core arranged directly on the bottom of the flask.

* * * * *